US005680162A

United States Patent [19]

Taylor et al.

[11] Patent Number: 5,680,162

[45] Date of Patent: Oct. 21, 1997

[54] MULTIPLE CHIMNEYS FOR INK JET PRINTER

[75] Inventors: Bret Taylor; Mark S. Hickman, both of Vancouver, Wash.

[73] Assignee: Hewlett-Packard Company, Palo Alto, Calif.

[21] Appl. No.: 379,235

[22] Filed: Jan. 27, 1995

Related U.S. Application Data

[63] Continuation-in-part of Ser. No. 316,152, Sep. 30, 1994.

[51] Int. Cl.[6] ..... B41J 2/165

[52] U.S. Cl. ..... 347/35; 347/24; 347/36

[58] Field of Search ..... 347/22, 23, 29, 347/30, 32, 34, 35, 24, 36

[56] References Cited

U.S. PATENT DOCUMENTS

| | | | |
|---|---|---|---|
| 4,362,572 | 12/1982 | Wallace | 134/18 |
| 4,695,851 | 9/1987 | Terasawa | 347/30 |
| 4,712,172 | 12/1987 | Kiyohara et al. | 347/60 |
| 4,728,970 | 3/1988 | Terasawa | 347/30 |
| 4,967,204 | 10/1990 | Terasawa et al. | 346/23 |
| 5,155,497 | 10/1992 | Martin et al. | 347/33 |

FOREIGN PATENT DOCUMENTS

| | | |
|---|---|---|
| 0465260 | 7/1991 | European Pat. Off. . |
| 0574268 | 12/1993 | European Pat. Off. . |

*Primary Examiner*—John E. Barlow, Jr.

[57] ABSTRACT

An inkjet printing mechanism has multiple inkjet printheads which controllably eject multiple ink droplets, and has a carriage to carry the printhead. The carriage is designed to move the printhead through a print zone to a service station where the printhead is serviced. During a servicing mode of operation, the printheads eject ink droplets at the service station to clear the orifices of the nozzles of the printheads prior to printing. A reservoir is provided at the service station to collect the ink droplets ejected from the printheads during the servicing mode. Multiple chimneys receive ink from the multiple printheads and guide ink from different printheads to different areas of the reservoir. Precipitates that may form when different inks combine are kept away from the chimneys.

18 Claims, 3 Drawing Sheets

MULTIPLE CHIMNEYS FOR INK JET PRINTER

CROSS REFERENCE TO RELATED APPLICATION

This application is a continuation-in-part of copending U.S. patent application Ser. No. 08/316,152 filed Sep. 30, 1994 titled "Venturi Spittoon System to Control Inkjet Aerosol", invented by James Cameron and Bret Taylor, and assigned to the assignee of the present invention.

FIELD OF THE INVENTION

This invention relates to inkjet printing mechanisms, and more particularly, to mechanisms for controlling inkjet aerosol in ink-jet printers, plotters, scanners, facsimile machines, and the like.

BACKGROUND OF THE INVENTION

An inkier printing mechanism is a type of non-impact printing device which forms characters and other images by controllably spraying drops of ink from a printhead. Inkier printing mechanisms may be employed in a variety of devices, such as printers, plotters, scanners, facsimile machines, and the like. For convenience, inkier printers are used herein to illustrate the concepts of the present invention.

The printhead ejects ink through multiple nozzles in the form of drops which travel across a small air gap and land on a recording media. Different nozzles are employed for different colors. The drops are very small. inkjet printers commonly print within a range of 180 to 600 dots per inch (dpi). The ink drops dry on the recording media shortly after deposition to form the desired printed images.

There are various types of inkier printheads including, for example, thermal inkier printheads and piezoelectric inkjet printheads. By way of example, for a thermal inkier printhead, ink droplets are ejected from individual nozzles by localized heating. A small heating element is disposed at individual nozzles. An electrical current is passed through the element to heat it up. This causes a tiny volume of ink to be rapidly heated and vaporized by the heating element. Once vaporized, the ink is ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the printhead for forming desired images on the recording media.

During start-up just prior to a printing cycle, it is common to maneuver the printhead to a service station and prepare the printhead by firing ink drops into a reservoir assembly (often called a "spittoon"). Sometimes hundreds, or even tens of thousands, of ink drops are rapidly fired into the reservoir assembly. This preliminary firing clears the nozzles and orifices of any ink build-up or debris in preparation for a more controllable ink deposition when the printhead is returned to the recording media. The printhead returns to the service station periodically while printing is in progress to re-clean the nozzles. Routine servicing of this type, to re-clean the nozzles, is commonly scheduled once to twice per page of printing. The cleansing process helps maintain printhead reliability.

SUMMARY OF THE INVENTION

U.S. patent application Ser. No. 08/316,152, filed Sep. 30, 1994, titled "Venturi Spittoon System to Control Inkjet Aerosol," invented by James Cameron and Bret Taylor and assigned to the assignee of the present invention, discloses (see FIG. 6) multiple venturi passageways for multiple printheads. The venturi passageways lead into a common reservoir. The invention of the instant application is related to this feature.

According to one aspect of the present invention, a unique reservoir assembly is provided for use in an inkjet printing mechanism. The reservoir assembly includes a plurality of chimneys which collect ink droplets ejected by inkjet nozzles during a servicing mode. Different nozzles deposit droplets in different chimneys. The chimneys channel waste ink to one or more collection areas which collect the waste ink. By providing different chimneys for different nozzles, precipitation that may occur if different color inks come into contact with one another is kept away from the chimneys. Thus, clogging of the chimneys is avoided.

In one aspect of the invention, one chimney receives black ink, and another chimney receives color ink.

In one aspect of the invention, absorbent material, such as an absorbent pad, is provided in the collection area or areas and absorbs ink deposited therein.

The chimneys channel the waste ink to a collection area that is larger in volume than a collection area that could be employed if the chimneys were omitted and ink was deposited from the nozzles directly into the collection area.

In another aspect of the invention, two chimneys lead to a single reservoir where ink from the separate chimneys mix together. More particularly, the reservoir contains an absorbent pad, and ink from the separate chimneys mix together on the pad, which mixing results in the formation of a precipitate at a location between the chimneys. Because the precipitate forms laterally between the chimneys, it is far enough away from each chimney that clogging of the chimneys is avoided.

DESCRIPTION OF THE DRAWINGS

Preferred embodiments of the invention are described below with reference to the following accompanying drawings. The drawings depict examples embodying the best mode for practicing the invention.

FIG. 1 shows a movable carriage, holding a printhead, and a reservoir assembly including two chimneys for receiving ink during a servicing mode.

DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

The present invention relates to inkjet printing mechanisms which can be used in many different printing devices, including inkjet printers, plotters, scanners, facsimile machines, and the like. In general, an inkjet printing mechanism has one or more inkjet printheads which controllably deposit drops of ink in prescribed patterns onto a recording media. As used herein, recording media includes all forms of printable matter including, for example, continuous paper, sheet stock paper, adhesive backed labels, mylar, and the like. A typical inkjet printhead has multiple nozzles (e.g., 50 nozzles), such as that described in U.S. Pat. No. 5,278,584 by Keefe et al., which is assigned to Hewlett-Packard Company, and which is incorporated herein by reference.

Figure 1:
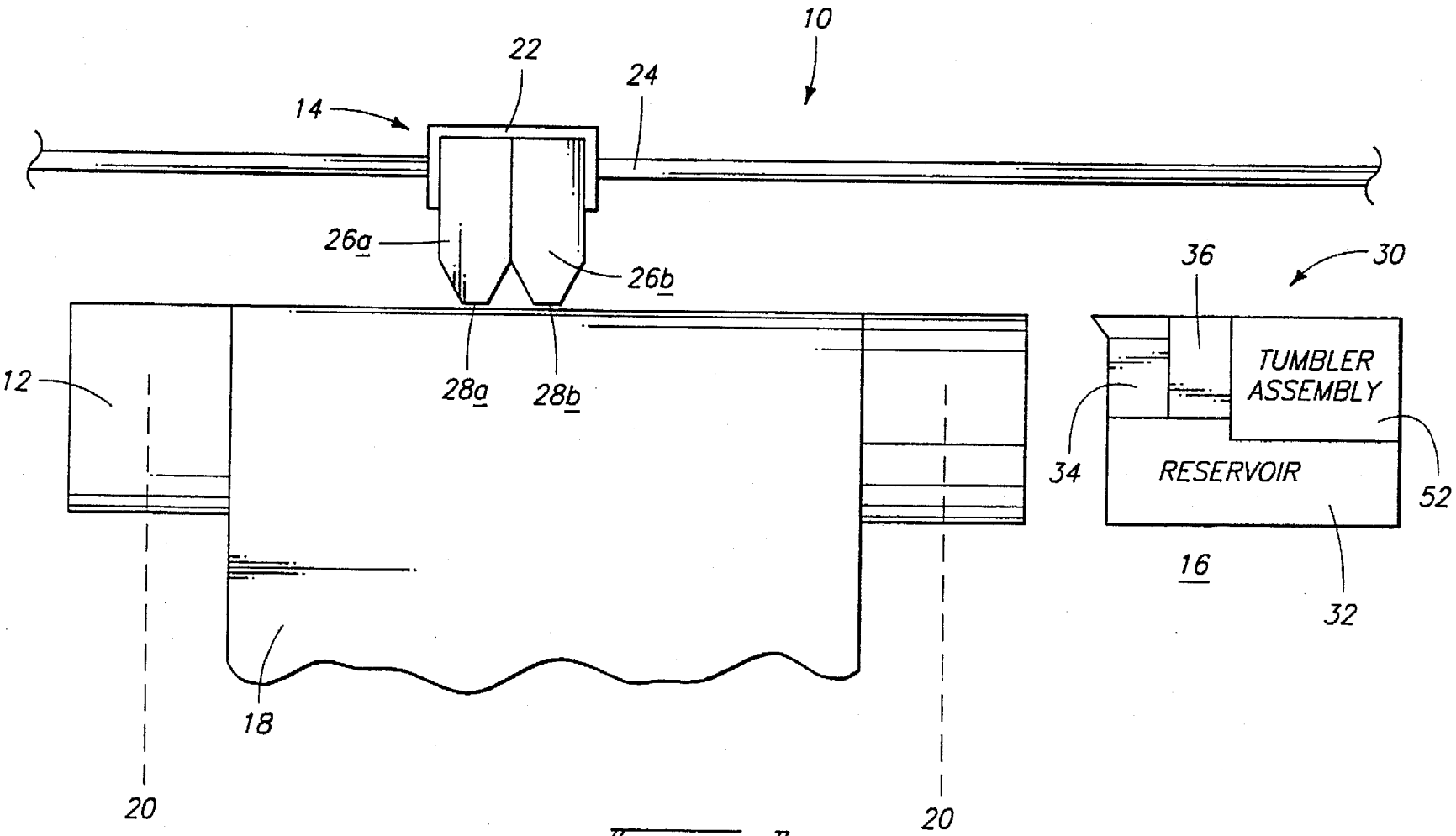
FIG. 1 is a diagrammatical side view of one form of an inkjet printing mechanism according to this invention.

FIG. 1 shows one embodiment of a shuttle-type inkjet printing mechanism 10 constructed according to this invention. Printing mechanism 10 includes a platen 12, a shuttle assembly 14, and a service station 16. Platen 12 supports a recording media 18 during printing. The platen can be stationary, or rotatable to assist in advancing the media through the printing mechanism. A media feed mechanism (not shown), such as conventional friction rollers or a tractor feed system, may be used to drive the media through the printing mechanism along a media feed path.

Printing mechanism 10 has a predefined print zone which is represented by dashed boundary lines 20. The print zone coincides at least partially with the media feed path so that the recording media is fed through the print zone. An example print zone is defined as an area within which each of the multiple printheads can print across the entire width of the recording media.

Shuttle assembly 14 includes a carriage 22 slidably mounted on a fixed, elongated guide rod 24 to move bidirectionally across platen 12. In the illustrated embodiment, carriage 22 is designed to maneuver over the full width of the platen, thereby entirely traversing print zone 20, as well as moving to service station 16 outside of the print zone. It is noted, however, that the service station may be located within or under the print zone. Shuttle assembly 14 includes a drive subassembly (not shown) that is mechanically coupled to drive carriage 22 back and forth along guide rod 24.

A typical drive subassembly includes a wire or belt attached to carriage 22 and wound around opposing pulleys, and a motor (e.g., a stepper motor or DC motor) connected to power one of the pulleys. A rotary or linear encoder is often coupled to the motor drive shaft to monitor incremental shaft rotation and provide feedback data for use in positioning and controlling the carriage, although some printers can be embodied without an encoder. The shuttle assembly 14 described herein is provided for explanation purposes and its construction is well known in the art. Other types of shuttle assembly configurations may alternatively be employed.

Carriage 22 supports and carries two printheads **26*a* and 26*b* which are preferably embodied as replaceable, disposable print cartridges or pens. Printheads 26*a* and 26*b* are mounted to carriage 22 so that their nozzle sections 28*a* and 28*b* are adjacent to, but spaced from, platen 12 to permit passage of the recording media therebetween. The carriage 22 moves the printhead back and forth through print zone 20** in horizontal swaths along a scan axis.

In the illustrated embodiment, printhead **26*a* is a multi-color pen which deposits multiple colors, such as Cyan, Magenta, and Yellow. An example multi-color printhead is sold by Hewlett-Packard under part number 51625A. In the illustrated embodiment, printhead 26*b*** is a monochrome pen which deposits black ink.

Carriage 22 is illustrated as moving printheads **26*a* and 26*b* out of print zone 20 to service station 16 where the printheads are serviced. Service station 16 is preferably located adjacent to platen 12 and outside of print zone 20, although it may alternatively be located within or under the print zone. The printheads 26*a* and 26*b*** are moved to the service station during initialization procedures and then intermittently during printing.

The printheads **26*a* and 26*b* undergo various servicing processes at the service station including "spitting" where the printheads 26*a* and 26*b*** fire multiple ink droplets to clear the nozzles and orifices of any ink build-up or debris.

Figure 2:
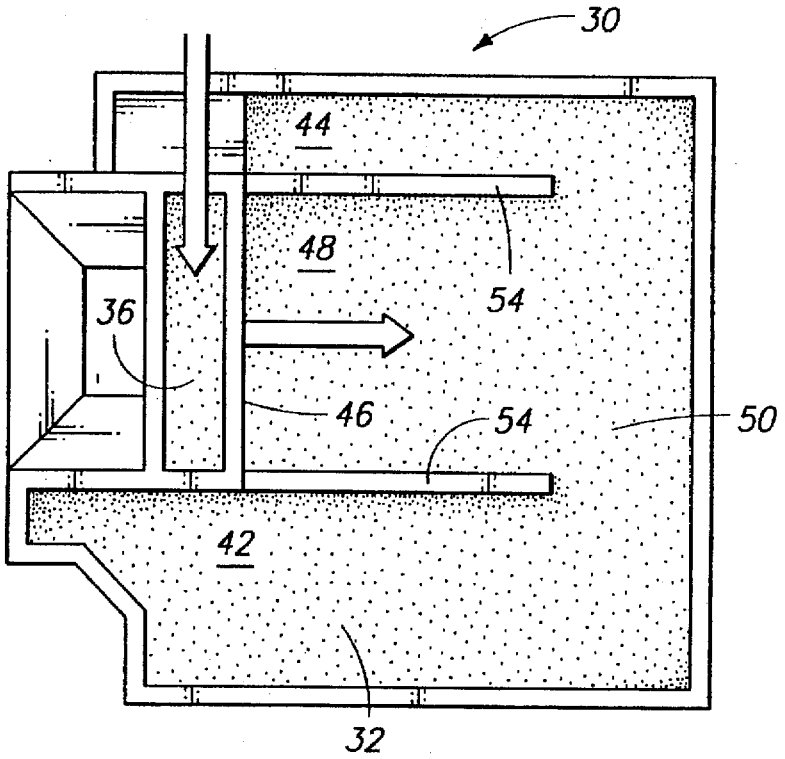
FIG. 2 is a top view of the reservoir assembly of FIG. 1, showing a flow path of ink received from the printhead into one of the chimneys.
Figure 3:
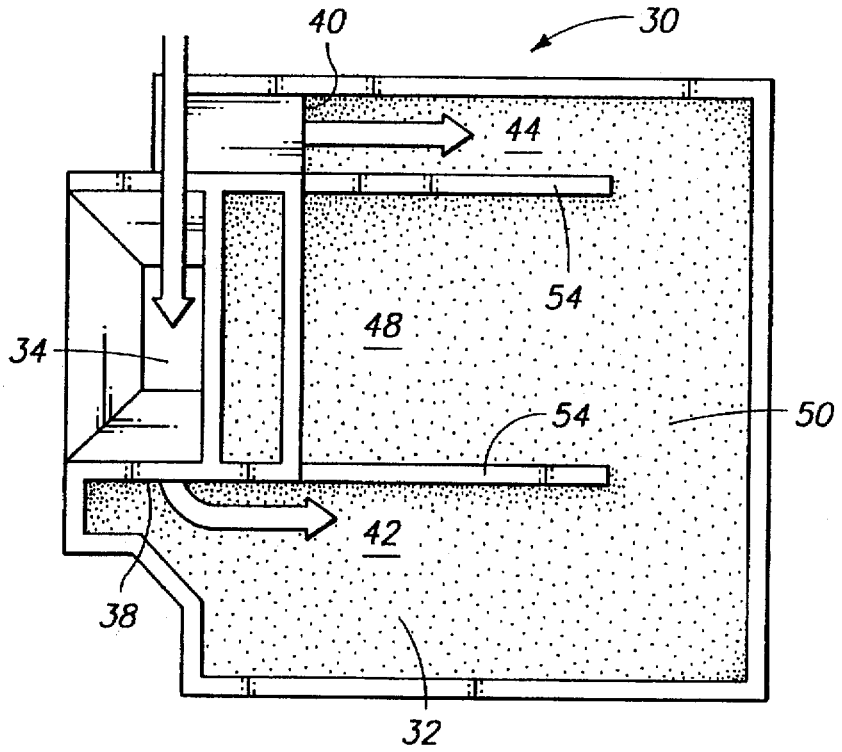
FIG. 3 is a top view of the reservoir assembly of FIG. 1, showing a flow path of ink received from the printhead into the other of the chimneys.
Figure 4:
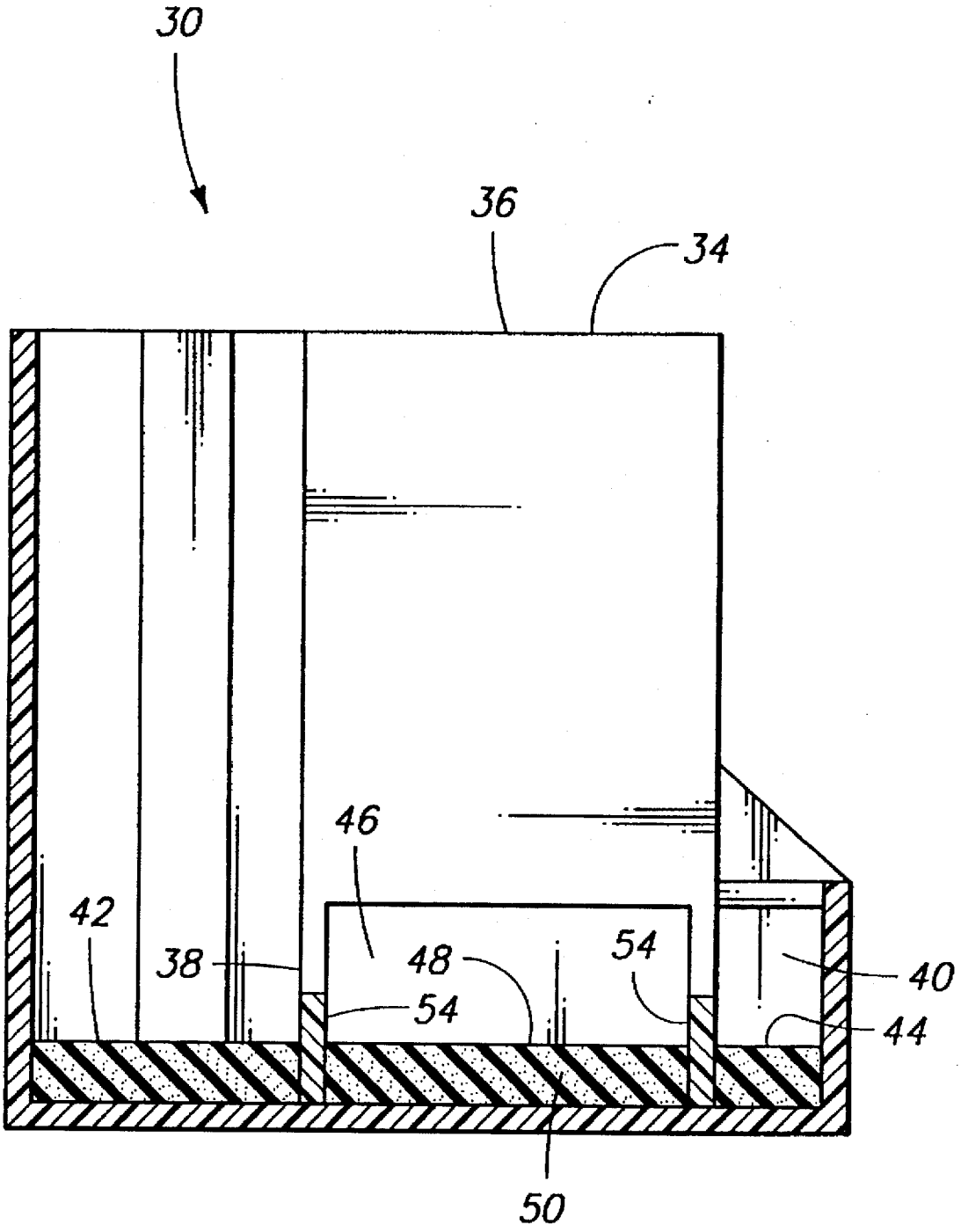
FIG. 4 is a cut away side elevational view of the reservoir assembly of FIG. 1.

Service station 16 has a reservoir assembly 30 for receiving the ink droplets ejected from the printhead 26 during the servicing mode. Reservoir assembly 30 includes a reservoir 32 to collect the ink droplets, and includes side by side chimneys 34 and 36 positioned intermediate of the printheads **26*a* and 26*b* and reservoir 32 to guide the ink droplets from the printheads into the reservoir 32. In the illustrated embodiment, a common wall separates the chimneys 34 and 36. The chimneys 34 and 36 extend vertically and carry the ink droplets vertically downwardly in the direction shown in FIGS. 2 and 3 by the arrows. In the illustrated embodiment, the chimneys 34 and 36** have generally rectangular cross sections, although other shapes are possible.

When the printheads **26*a* and 26*b* move to the service station 16, nozzle sections 28*a* and 28*b* of printheads 26*a* and 26*b* are adjacent to, but spaced slightly above, chimneys 34 and 36 when the printheads are positioned above the reservoir assembly 30. Preferably, the printhead nozzle sections 28*a* and 28*b* are spaced from the top of the chimneys 34 and 36** by a distance of approximately 0.5 to 2 mm.

After the printheads **26*a* and 26*b* are positioned over reservoir assembly 30, they are fired many times (perhaps hundreds or thousands of times) to clear the nozzles and orifices of any ink build-up or debris. The printheads 26*a* and 26*b* can be fired either simultaneously or at separate times. The ink droplets exit the printheads 26*a* and 26*b* at a comparatively high velocity into the chimneys 34 or 36**. The ink droplets entrain the surrounding air to create an air flow into the reservoir.

The chimney 34 has two lower openings 38 and 40, and ink travelling down chimney 34 diverges (FIG. 3) at these openings 38 and 40 to travel to areas 42 and 44 at the bottom of the reservoir 32. The chimney 36 has a single lower opening 46 (FIG. 2), and ink travelling down chimney 36 travels to area 48 at the bottom of the reservoir 32.

Different nozzles deposit droplets into different chimneys. In the illustrated embodiment, printhead **26*a* deposits droplets into chimney 34, and printhead 26*b* deposits droplets into chimney 36. The chimneys 34 and 36 channel waste ink from the different printheads 26*a* and 26*b* to different collection areas 42 and 44, and 48 of the common reservoir 32. In one embodiment of the invention, absorbent material, such as an absorbent pad 50, is provided at the bottom of the reservoir 32 and collects ink deposited to the areas 42, 44, and 46**.

By providing different chimneys for different nozzles, precipitation that may occur if different color inks come into contact with one another is kept away from the chimneys. Thus, clogging of the chimneys is avoided.

In one embodiment of the invention, one chimney receives black ink, and another chimney receives color ink. More particularly, in the illustrated embodiment, the printhead **26*a* is a color printhead and fires ink into chimney 34, and the printhead 26*b* is a black printhead and fires ink into chimney 36. A precipitate forms when the black ink meets the color ink on the pad 50. This is how the latest inks prevent mixing when color contacts black. The black ink has a charged polymer attached to black pigment to make it dispersible. The color ink contains dissolved metallic ions of the opposite charge. When the color ink meets the black ink, the black polymer charge is neutralized and a solid precipitates out of solution. The precipitate forms a natural barrier between the area 48 and the area 44; and between the area 48 and the area 42. In the illustrated embodiment, short vertical barriers 54** are also provided to separate these areas at least for a predetermined horizontal distance from the chimneys. In other embodiments of the invention, if various colored inks precipitate with other color inks, separate chimneys are provided for receiving the different color inks.

Other processes that take place at the service station 16 are performed by tumbler assembly 52, which is located above the areas 42, 44, and 48 of the reservoir 32. The tumbler assembly performs such processes as: "wiping" where wipers physically wipe the respective nozzle sections of the printheads 26*a* and 26*b* to clean them; "priming" where a pressure gradient is created within the ink conduits of the printhead 26 to prepare the ink stream for continuous flow into the ejecting heating element or to forcibly remove trapped air bubbles and other debris; and "capping" to prevent ink in the printheads 26*a* and 26*b* from drying out. The tumbler assembly 52 includes structure for performing the "wiping", "priming", and "capping". These processes, in combination with the "spitting" into the chimneys 34 and 36, prepare the printheads 26*a* and 26*b* for high quality ink deposition when the printheads are returned to the print zone to print on the recording media. Routine servicing is typically scheduled once or twice per page of printing. These processes help maintain reliability of the printheads. The location of the tumbler assembly 52 above the reservoir 32 is advantageous because should a problem arise in performing the wiping, priming, or capping, which results in spilling of ink from the printheads 26*a* and 26*b*, the ink will be captured in the reservoir 32. Space savings are also achieved. In one embodiment of the invention, the tumbler assembly 52 and reservoir assembly 30 are a modular unit that can be replaced as a unit if any subcomponent of the tumbler assembly 52 or reservoir assembly 30 fails. The reservoir 32 is designed to accommodate ink for the lifetime of the printing mechanism 10, and should not need emptying.

The reservoir assembly of this invention is advantageous because it provides an efficient and effective technique for controlling inkjet aerosol. Additionally, precipitates which tend to cause clogging and shorten the life of reservoirs can be kept away from the chimneys.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet printing mechanism, comprising:

a plurality of inkjet printheads which each controllably eject multiple ink droplets;

a carriage that carries the printheads through a print zone to a service station where at least one of the printheads controllably ejects ink droplets during a servicing mode;

a reservoir located at the service station to collect the ejected ink droplets;

a plurality of chimneys positioned adjacent to the reservoir, different ones of the chimneys receiving ink droplets ejected from different ones of the printheads and guiding the ink droplets ejected from the different printheads to different areas of the reservoir; and wherein the chimneys each have a horizontal cross-sectional area, and the reservoir has a horizontal area that is greater than the combined horizontal cross-sectional areas of all of the chimneys.

2. An inkjet printing mechanism according to claim 1 wherein each chimney has a rectangular cross-section, and wherein adjacent chimneys have a common wall separating the adjacent chimneys.

3. An inkjet printing mechanism according to claim 1 wherein one of the printheads ejects black ink, and another of the printheads ejects color ink.

4. An inkjet printing mechanism according to claim 1 wherein the printheads are moveable together, and are positionable adjacent the chimneys such that when a first one of the printheads is adjacent a first one of the chimneys where the first chimney can receive ink droplets ejected from the first printhead, a second of the printheads is adjacent a second of the chimneys where the second chimney can receive ink droplets ejected from the second printhead.

5. An inkjet printing mechanism according to claim 1 wherein the number of chimneys is equal to the number of printheads.

6. An inkjet printing mechanism according to claim 5 wherein respective chimneys are aligned with respective printheads when the printheads eject ink droplets during the servicing mode.

7. An inkjet printing mechanism according to claim 1, wherein the printheads are vertically above the chimneys, and eject ink vertically downwardly into the chimneys, when the printheads eject ink droplets during the servicing mode.

8. An inkjet printing mechanism according to claim 1 wherein the reservoir receives ink from all of the chimneys.

9. A method for controlling inkjet aerosol, comprising the following steps:

ejecting ink droplets of different types of ink into multiple chimneys at a service station;

separately directing the different types of ink through different ones of the chimneys toward respective separate reservoir areas located at the service station to prevent mixing of the different types of ink for at least a predetermined minimum extent of ink travel; and allowing the different types of ink to mix in a common reservoir after the different types of ink have moved the predetermined minimum extent of ink travel to permit formation of any precipitate away from the chimneys.

10. An inkjet printing mechanism, comprising:

a plurality of inkjet printheads which each controllably eject multiple ink droplets, one of the printheads ejecting ink having a charged polymer, and another one of the printheads ejecting ink having metallic particles of a charge opposite to the charge of the polymer;

a carriage that carries the printheads through a print zone to a service station where at least one of the printheads controllably ejects ink droplets during a servicing mode;

a reservoir located at the service station to collect the ejected ink droplets; and a plurality of chimneys positioned adjacent to the reservoir, different ones of the chimneys receiving and guiding ink droplets ejected from different ones of the printheads.

11. An inject printing mechanism, comprising:

a plurality of inkjet printheads which each controllably eject multiple ink droplets, one of the inkjet printheads controllably ejecting a first type of ink, and another one of the inkjet printheads controllably ejecting a second type of ink, wherein a precipitate forms if the first type of ink contacts the second type of ink;

a carriage that carries the printheads through a print zone to a service station where at least one of the printheads controllably ejects ink droplets during a servicing mode;

a reservoir assembly including a plurality of reservoir areas located at the service station to collect the ejected ink droplets, the reservoir assembly further including a plurality of chimneys positioned adjacent to the reservoir area, one of the chimneys receiving and guiding ink droplet ejected from the printhead that ejects the first type of ink to a first one of the reservoir areas, and another one of the chimneys to receiving and guiding ink droplets elected from the printhead that ejects the second type of ink to a second one of the reservoir areas spaced from the first area; and wherein each chimney has a horizontal cross-sectional area, and wherein the reservoir areas have a combined horizontal area that is greater than the combined horizontal cross-sectional areas of all of the chimneys.

12. An inkier printing mechanism, comprising:

a plurality of inkjet printheads which each controllably eject multiple ink droplets, one of the inkjet printheads controllably ejecting a first type of ink, and another one of the inkier printheads controllably ejecting a second type of ink, wherein a precipitate forms if the first type of ink contacts the second type of ink;

a carriage that carries the printheads through a print zone to a service station where at least one of the printheads controllably ejects ink droplets during a servicing mode; and a reservoir assembly including a plurality of reservoir areas located at the service station to collect the ejected ink droplets, the reservoir assembly further including a plurality of chimneys positioned adjacent to the reservoir area, one of the chimneys receiving and guiding ink droplets ejected from the printhead that ejects the first type of ink to a first one of the reservoir areas, and another one of the chimneys to receiving and guiding ink droplets ejected from the printhead that ejects the second type of ink to a second one of the reservoir areas spaced from the first area; and the reservoir assembly further including a common reservoir defining the first and second reservoir areas, wherein the first and second types of ink mix in the reservoir to form the precipitate at a location spaced from the chimneys, whereby the precipitate that forms is kept away from the chimneys.

13. An inkjet printing mechanism according to claim 12 wherein the printheads are vertically above the chimneys, and eject ink vertically downwardly into the chimneys, when the printheads eject ink droplets during the servicing mode.

14. An inkjet printing mechanism according to claim 12 wherein each chimney has a rectangular cross-section.

15. An inkjet printing mechanism according to claim 12 wherein the printheads are moveable together, and are positionable adjacent the chimneys such that when a first one of the printheads is adjacent a first one of the chimneys where the first chimney can receive ink droplets ejected from the first printhead, a second of the printheads is adjacent a second of the chimneys where the second chimney can receive ink droplets ejected from the second printhead.

16. An inkjet printing mechanism according to claim 12 wherein the number of chimneys is equal to the number of printheads, and wherein respective chimneys are aligned with respective printheads when the printheads eject ink droplets during the servicing mode.

17. A reservoir assembly for use in an inkjet printing mechanism, the inkier printing mechanism having multiple inkjet printheads which controllably eject multiple ink droplets, the reservoir assembly comprising:

a reservoir;

multiple chimneys adapted to receive ink droplets ejected from corresponding ones of the printheads and to direct the ink droplets from the corresponding printheads into different areas of the reservoir; and wherein the chimneys each have a horizontal cross-sectional area, and the reservoir has a horizontal area that is greater than the combined horizontal cross-sectional areas of all of the chimneys.

18. An inkjet printer comprising the reservoir assembly as recited in claim 17.

* * * * *

UNITED STATES PATENT AND TRADEMARK OFFICE

CERTIFICATE OF CORRECTION

PATENT NO. : 5,680,162

DATED : October 21, 1997

INVENTOR(S) : Taylor et al.

It is certified that error appears in the above-identified patent and that said Letters Patent is hereby corrected as shown below:

Column 1 (line 7), delete "patent application" and insert therefor --Patent Application--.

Column 1 (line 19), delete "inkier" and insert therefor --inkjet--.

Column 1 (line 21), delete "Inkier" and insert therefor --Inkjet--.

Column 1 (line 24), delete "inkier" and insert therefor --inkjet--.

Column 1 (line 30), delete "inkjet" and insert therefor --Inkjet--.

Column 1 (line 35), delete "inkier" and insert therefor --inkjet--.

Column 1 (line 36), delete "inkier" and insert therefor --inkjet--.

Column 1 (line 37), delete "inkier" and insert therefor --inkjet--.

Column 1 (line 66), delete "patent application" and insert therefor --Patent Application--.

UNITED STATES PATENT AND TRADEMARK OFFICE

CERTIFICATE OF CORRECTION

PATENT NO. : 5,680,162

DATED : October 21, 1997

INVENTOR(S) : Taylor et al.

It is certified that error appears in the above-identified patent and that said Letters Patent is hereby corrected as shown below:

Column 7, (line 5), delete "inject" and insert therefor --inkjet--.

Column 7 (line 21), delete "droplet" and insert therefor --droplets--.

Column 7 (line 24), delete "elected" and insert therefor --ejected--.

Column 7 (line 32), delete "inkier" and insert therefor --inkjet--.

Column 7 (line 36) delete "inkier" and insert therefor --inkjet--.

UNITED STATES PATENT AND TRADEMARK OFFICE

CERTIFICATE OF CORRECTION

PATENT NO. : 5,680,162

DATED : October 21, 1997

INVENTOR(S) : Taylor, et. al.

It is certified that error appears in the above-identified patent and that said Letters Patent is hereby corrected as shown below:

Column 8 (line 34), delete "inkier" and insert therefor --inkjet--.

Signed and Sealed this

Thirtieth Day of June, 1998

*Attest:*

Bruce Lehman

BRUCE LEHMAN

*Attesting Officer*

*Commissioner of Patents and Trademarks*